US006183339B1

(12) United States Patent
Thompson

(10) Patent No.: US 6,183,339 B1
(45) Date of Patent: Feb. 6, 2001

(54) LADIES' SLEEVED UNDERGARMENT

(76) Inventor: Kathryn H. Thompson, 227 Falcon Ridge Rd., Great Falls, VA (US) 22066

( * ) Notice: Under 35 U.S.C. 154(b), the term of this patent shall be extended for 0 days.

(21) Appl. No.: 09/595,899

(22) Filed: Jun. 20, 2000

(51) Int. Cl.[7] ..... A41C 3/00
(52) U.S. Cl. ..... 450/1; 2/55
(58) Field of Search ..... 450/1, 30–34, 450/7–17, 86; 2/109, 110, 78.1, 71–73, 90, 55, 106, 115, 125

(56) References Cited

U.S. PATENT DOCUMENTS

| | | | | |
|---|---|---|---|---|
| 24,033 | | 5/1859 | Lesher . | |
| D. 232,602 | * | 9/1974 | Greenblatt | 450/1 |
| 593,175 | | 11/1897 | Heyman . | |
| 933,265 | * | 9/1909 | Reid | 450/1 |
| 1,236,720 | | 8/1917 | Kotek . | |
| 1,254,043 | * | 1/1918 | James | 450/1 |
| 2,250,094 | * | 6/1941 | Cornibert et al. | 450/1 |
| 2,493,179 | * | 1/1950 | Wittenberg | 450/1 |
| 2,880,731 | | 4/1959 | Kendall . | |
| 3,421,514 | * | 1/1969 | Friedlander | 2/55 |
| 3,490,459 | | 1/1970 | Story . | |
| 3,746,007 | * | 7/1973 | Hand et al. | 450/31 |
| 3,826,266 | | 7/1974 | Alpert . | |
| 4,625,338 | | 12/1986 | Starling . | |
| 5,042,089 | * | 8/1991 | Carmer | 2/55 |
| 5,897,422 | | 4/1999 | McGee . | |
| 5,946,726 | | 9/1999 | Green . | |
| 6,000,993 | | 12/1999 | Erwin . | |

* cited by examiner

*Primary Examiner*—Gloria M. Hale
(74) *Attorney, Agent, or Firm*—Hunton & Williams

(57) ABSTRACT

A ladies' sleeved undergarment is provided for concealing or covering a wearer's arms without adding undue bulkiness about the torso of the wearer. The garment comprises a conventional brassiere with sleeves attached thereto. A principle object of this invention is to provide a ladies' sleeved undergarment that will conceal any flabbiness, wrinkles, or age spots that may exists on the arm of the wearer without adding undue bulkiness about the torso of the wearer.

6 Claims, 3 Drawing Sheets

LADIES' SLEEVED UNDERGARMENT

FIELD OF THE INVENTION

The present invention relates to ladies' sleeved undergarments, and more particularly to such an undergarment wherein the sleeves are capable of covering a wearers' arm without adding undue bulkiness about the torso of the wearer.

BACKGROUND OF THE INVENTION

It is natural for skin flabbiness and wrinkles to develop in the upper arms and forearms of a person due to muscle aging and excess weight. As a result, many people feel that their arms are heavy or unattractive, especially when wearing sleeveless apparel. At the present time, the primary option available to conceal one's arms when wearing sleeveless apparel is to wear a bulky sleeved undershirt beneath the sleeveless garment. However, many sleeveless garments on the market, such as tank-tops and form fitting dresses, are not designed to be worn such undershirts.

The present invention is able to conceal or cover a wearer's arms by use of a novel sleeved undergarment wherein the sleeves serve to cover the wearer's arms without adding undue bulkiness about the torso of the wearer. In addition to improving the physical appearance of the wearer, the unique garment allows for increased versatility to one's wardrobe.

SUMMARY OF THE INVENTION

A ladies' sleeved undergarment is provided for concealing a wearer's arms without adding undue bulkiness about the torso of the wearer. The undergarment comprises a conventional brassiere with sleeves attached thereto. The undergarment can further include a jersey covering over the brassiere, and the sleeves can include an elasticized portion along the under-arm of the intended wearer to further prevent undue bulkiness.

A principle object of the present invention is to provide a ladies' sleeved undergarment that will conceal any flabbiness, wrinkles, or age spots that may exists on the arm of the wearer without adding undue bulkiness about the torso of the wearer.

Another object of the present invention is to provide a ladies' sleeved undergarment that provides the support of a brassiere while covering the wearer's arms without adding undue bulkiness about the torso of the wearer to thereby add versatility to wearer's wardrobe.

DETAILED DESCRIPTION OF THE PREFERRED EMBODIMENTS

Figure 1:
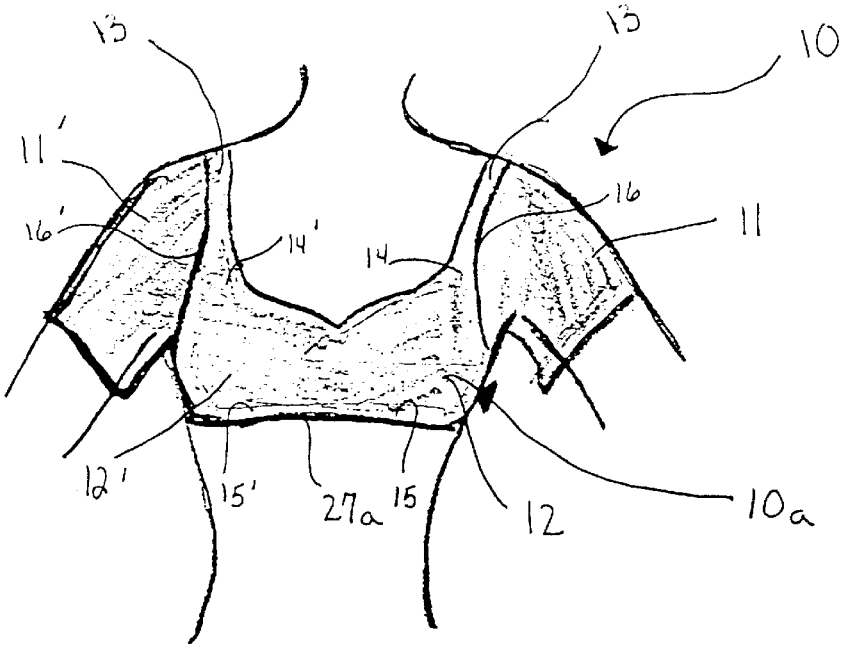
FIGS. 1 and 2 illustrate front and back views of a ladies' sleeved undergarment according to a preferred embodiment of the present invention.
Figure 2:
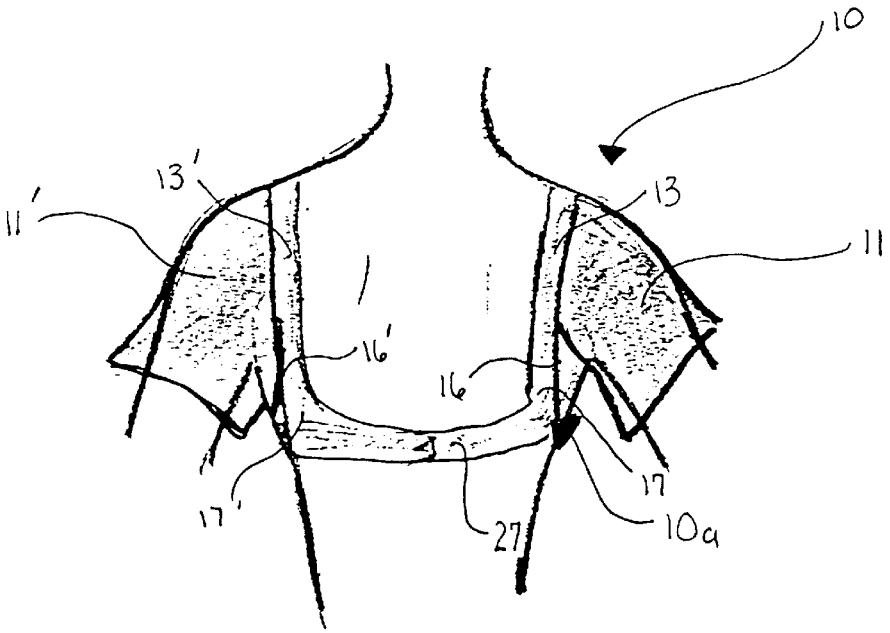

With reference to the drawings in detail, and initially to FIGS. 1–2 thereof, a novel sleeved ladies' undergarment 10 is provided in accordance with a preferred embodiment of the invention. The undergarment 10 generally comprises a traditional brassiere 10*a* with sleeves 11 and 11' attached thereto. The sleeves 11 and 11' can be long (not shown) or short, and can be shaped in any manner to achieve the desired coverage and appearance. For instance, the sleeves can be fitted around the wearer's arms for a sleek look (see FIGS. 1 and 2), or they can be loose and contoured or flared for a more formal look (see FIGS. 3 and 4).

The traditional brassiere 10*a* includes two breast-shaped cups 12 and 12', which are preferably substantially identical. Cups 12 and 12' attach to shoulder supports 13 and 13' along top attachment portions 14 and 14', and attach to a lower midriff edge 27*a* of a portion of back support 27 (shown in FIG. 2) along lower attachment portions 15 and 15'. Shoulder supports 13 and 13' preferably include anterior edges 16 and 16' encircling the shoulder of the wearer which terminate in sleeves 11 and 11'. The sleeves can be permanently attached to the shoulder supports, or alternatively can be removable.

Cups 12 and 12' can be formed from any suitable material known in the art including, but not limited to, lycra, spandex, cotton, or a combination thereof. Of course, other stretchable, or non-stretchable, fabrics can be employed. Cups 12 and 12' can further include underwires or any other conventional support features (not shown). Shoulder supports 13 and 13' and back support 27 can be formed from any materials known in the art and can be adjustable or unitary, as is known in the art.

In FIG. 2, the ladies' undergarment 10 depicted in FIG. 1 is shown in a rear view. Brassiere 10*a* includes the back portions of shoulder supports 13 and 13' which terminate in sleeves 11 and 11' along anterior edges 16 and 16' and connect at their lower attachment portions 17 and 17' to a back strap 27 in a generally conventional manner. Back strap 27 encircles the wearer's mid-torso region and fastens in a conventional manner using, for instance, hook-and-eye fasteners. Alternatively, back strap 27 and shoulder supports 13 and 13' could be configured as a unitary construction similar to conventional sports-bras (not shown).

Figure 3:
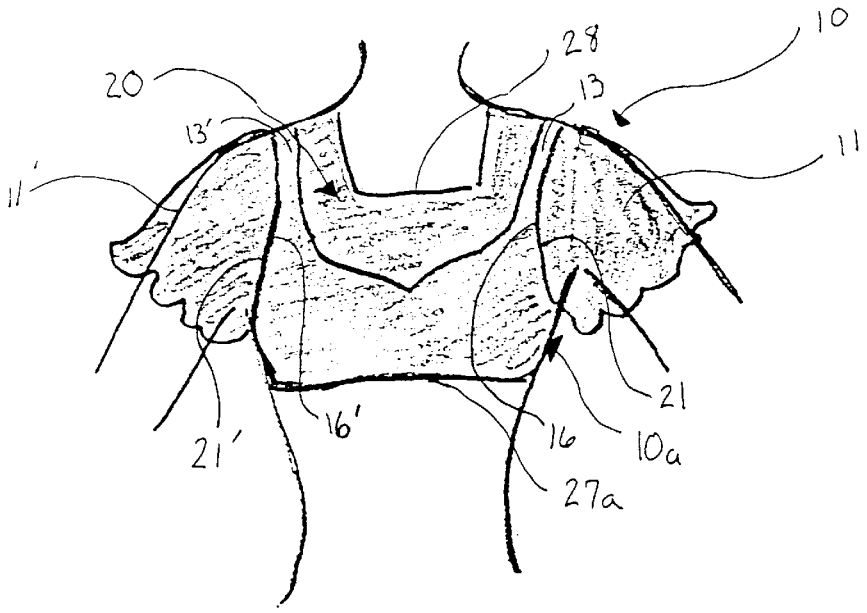
FIGS. 3 and 4 illustrate front and back views of another embodiment of the present invention including a jersey covering.

With reference to FIG. 3, an undergarment 10 similar to that depicted in FIG. 1 is shown. In the embodiment of FIG. 3, the sleeves 11 and 11' are loose and contoured for a more formal look. Further, brassiere 10*a* includes a jersey covering 20 which is attached to lower midriff edge 27*a* of back strap 27, and extends from lower midriff edge 27*a* to neckline 28 along the outer surface of brassiere 10*a*. The lateral edges 21 and 21' of jersey covering 20 extend to the anterior edges 16 and 16' of shoulder supports 13 and 13' and attach to sleeves 11 and 11' at anterior edges 16 and 16'. Alternatively, jersey covering 20 can attach directly to shoulder supports 13 and 13', which in turn can attach to sleeves 11 and 11'.

Jersey covering 20 can be formed from any material known in the art depending on the aesthetic qualities desired. For instance, cotton can be used for a more casual look, or sheer materials can be used for a more formal look. The jersey covering 20 can be formed from the same material as sleeves 11 and 11', or can be a different material if so desired. Neckline 28 can be shaped in any fashion known in the art, but preferably is square (shown in FIG. 3), crew, scoop, flat (shown in FIG. 5), or "v-neck" in shape.

Figure 4:
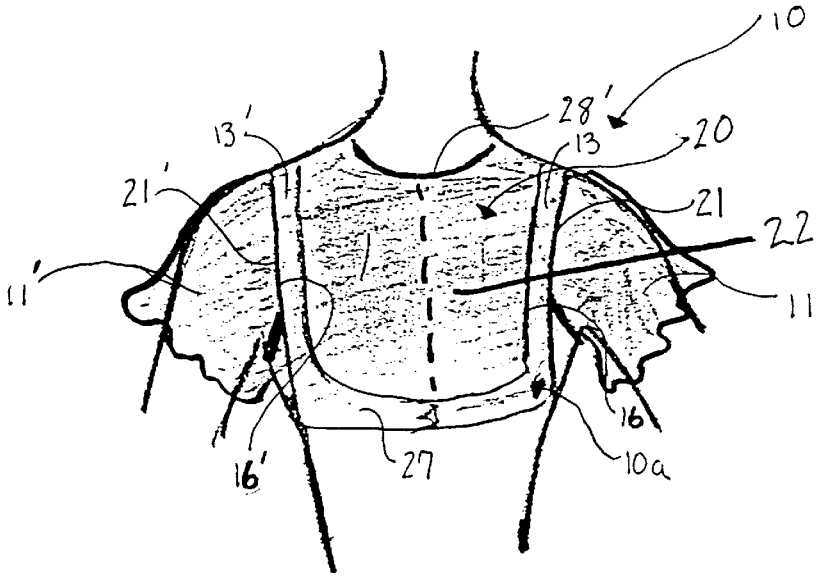
Figure 6:
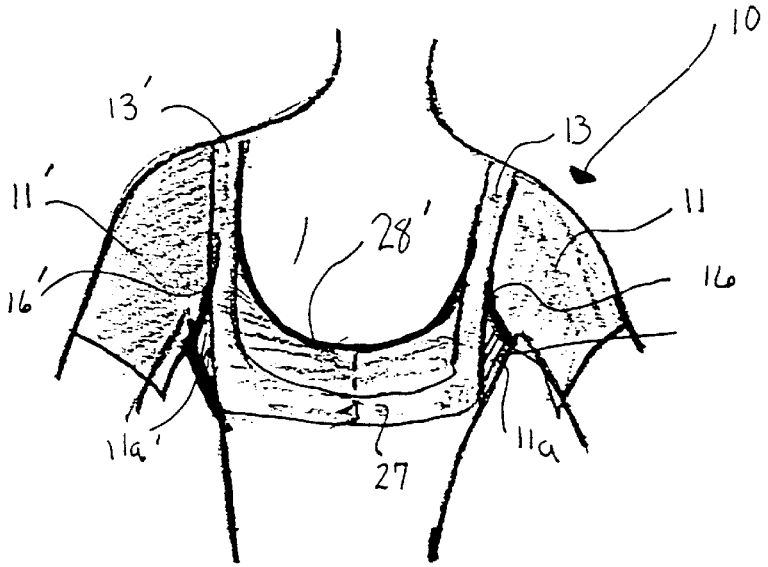

The back portion of jersey covering 20 can likewise be configured in a variety of ways, depending on the aesthetic qualities desired. For instance, the back portion of jersey covering 20 can vary in the extent of coverage and the back-neckline 28' shape. More particularly, the back portion of jersey covering 20 can extend from back strap 27 to just below the neck line of the wearer (as shown in FIG. 4), or can only extend from back strap 27 to a mid-region of the wearer's back (as shown in FIG. 6). Further, the back-neckline 28' can be shaped in any conventional manner, including square, crew (shown in FIG. 4), scoop (shown in FIG. 6), square, or "v-neck" in shape. Any combination of neckline or jersey covering configuration is possible and within the scope of the present invention.

Again, the lateral edges 21 and 21' of the back portion ofjersey covering 20 extend to the anterior edges 16 and 16' of shoulder supports 13 and 13' and attach to sleeves 11 and 11' at anterior edges 16 and 16'. Alternatively, jersey covering 20 can attach directly to shoulder supports 13 and 13', which in turn can attach to sleeves 11 and 11'. The back portion of jersey 20 can fasten together using any type of conventional faster 22, including, but not limited to, hook-and-loop fasteners, hook-and-eye fasteners, snaps, or buttons.

As discussed above, the ladies' sleeved undergarment according to the present invention allows for the cover or concealment of a wearer's arms without the addition of undue bulkiness about the torso of the wearer. The term "undue bulkiness" is intended to mean bulkiness which significantly inhibits the free movement of the wearer, or significantly detracts from the aesthetic appearance of the wearer, as readily understood by one of skill in the art. This is accomplished by providing a conventional brassiere with sleeves attached thereto. In order for a wearer to conceal one's arms, the wearer need only wear the ladies' sleeved undergarment of the present invention rather than a brassiere in conjunction with an bulky undershirt, as previously known.

Undue bulkiness is also prevented by virtue of the cropped form of the sleeved undergarment of the present invention. For example, the sleeved undergarment does not extend below the lower midriff edge of the back strap of the brassiere, thereby eliminating any bulk about the lower portion of the torso of the wearer.

Figure 5:
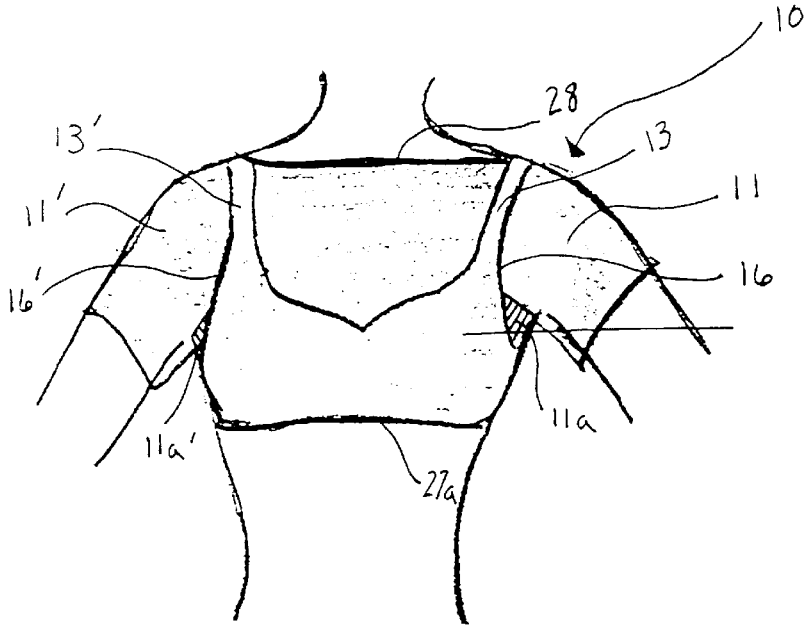
FIGS. 5 and 6 illustrate front and back views of yet another embodiment of the present invention including tight fit under-arm regions.

In a particularly preferred embodiment of the present invention, bulkiness can be further prevented by providing sleeves 11 and 11' with portions of tight fitting material 11*a* and 11*a*' along the under-arm region between the front and back anterior edges 16 and 16' of shoulder straps 13 and 13', as shown in FIGS. 5 and 6. In this preferred embodiment, bulkiness is reduced by providing for a snug fit along the under-arm region of the wearer to thereby result in a smoother look when worn. The material used in this tight fitting area can be any elasticized or stretchable material known in the art, but preferably is the same material used in forming the cups of the brassiere.

While the present invention has primarily been described with reference to concealing the arm's of the wearer, it should be understood that the garment can be worn in any situation where the wearer desires to expand the versatility of their sleeveless apparel. For instance, wearer's of all ages could use the sleeved garment of the present invention in situations where sleeveless apparel might otherwise be inappropriate or undesirable, such as cooler weather. As such, the sleeved garment of the present invention can be used under any circumstances where the wearer desires to obtain the support of a brassiere and cover their arms, all without undue bulkiness about their torso.

While particular embodiments of the present invention have been described and shown, the invention is not intended to be restricted to any particular construction, arrangement, or specific embodiment disclosed herein, or any specific method or operation or use, since the same may be modified in various particulars, without departing from the spirit or scope of the invention herein shown, the scope of which is set forth in the claims.

What is claimed is:

1. A ladies' sleeved undergarment for covering an intended wearer's arms without adding undue bulkiness about the torso of the intended wearer comprising:

a brassiere including a pair of support cups, a pair of shoulder supports having anterior edges which encircle the arms of the intended wearer, and a back strap which encircles the mid-torso region of the intended wearer, a pair of sleeves extending from the anterior edges of the shoulder supports for covering the intended wearer's arms without adding undue bulkiness about the torso of the intended wearer, and a jersey covering over the surface of the brassiere.

2. The ladies' sleeved undergarment of claim 1 wherein each of the sleeves include an elasticized portion along the under-arm region of the intended wearer to further prevent undue bulkiness about the torso of the intended wearer.

3. The ladies' sleeved undergarment of claim 1 wherein said sleeves are permanently attached to said shoulder supports.

4. A ladies' sleeved undergarment for covering an intended wearer's arms without adding undue bulkiness about the torso of the intended wearer comprising:

a brassiere including a pair of support cups, a pair of shoulder supports having anterior edges which encircle the arms of the wearer, and a back strap which encircles the mid-torso region of the intended wearer, and a pair of sleeves extending from the anterior edges of the shoulder supports for covering the intended wearer's arms without adding undue bulkiness about the torso of the intended wearer, wherein each of the sleeves include an elasticized portion along the under-arm region of the intended wearer to further prevent undue bulkiness about the torso of the intended wearer.

5. The ladies' sleeved undergarment of claim 4 further comprising a jersey covering over the surface of said brassiere.

6. The ladies' sleeved undergarment of claim 4 wherein the sleeves are permanently attached to the shoulder supports.

* * * * *